US005898142A

United States Patent [19]

Ohtaki et al.

[11] Patent Number: 5,898,142

[45] Date of Patent: Apr. 27, 1999

[54] CONTACT STRUCTURE OF A SLIDING SWITCH

[75] Inventors: Kazue Ohtaki; Mineo Hirano, both of Tokyo, Japan

[73] Assignee: Niles Parts Co., Ltd., Japan

[21] Appl. No.: 08/872,928

[22] Filed: Jun. 11, 1997

[30] Foreign Application Priority Data

Jun. 28, 1996 [JP] Japan ..... 8-186922

[51] Int. Cl.[6] ..... H01H 15/06

[52] U.S. Cl. ..... 200/16 C; 200/550; 200/252

[58] Field of Search ..... 200/252, 253, 200/549, 550, 541, 561, 563, 571, 16 C

[56] References Cited

U.S. PATENT DOCUMENTS 3,339,032 8/1967 Hults ..... 200/561 X 4,417,107 11/1983 Terajima ..... 200/16 C 5,587,886 12/1996 Lan ..... 200/252 X

FOREIGN PATENT DOCUMENTS 2265255 9/1993 United Kingdom ..... 200/550

*Primary Examiner*—Renee S. Luebke

*Attorney, Agent, or Firm*—Rader, Fishman & Grauer; Ronald P. Kananen

[57] ABSTRACT

In order to prevent resin around fixed contacts from being carbonized by an arc produced when a movable contact plate is brought into contact with the fixed contacts and separated therefrom, a sliding switch comprises a terminal plate provided with two fixed contact plates and a movable plate provided with a movable contact plate, which is brought into contact with the fixed contact plates. Each of the fixed contact plates has a fixed contact protruding from the terminal plate. The movable contact plate includes at least a pair of protrusions on both sides thereof.

6 Claims, 5 Drawing Sheets

CONTACT STRUCTURE OF A SLIDING SWITCH

FIELD OF THE INVENTION

The present invention relates to a contact structure of a sliding switch and, in particular, to a contact structure of a sliding switch, in which resin around fixed contact plates is prevented from being carbonized by an arc produced when a movable contact is brought into contact with fixed contacts or separated therefrom.

DESCRIPTION OF THE PRIOR ART

A conventional contact structure for a sliding switch is disclosed, for example, in Japanese Utility Model-A-Sho 58-44714. In this conventional sliding switch, a protruding portion and an air gap are formed between two fixed contact plates so that contact defects due to wear dust, and so forth, are prevented.

However, the conventional sliding switch had a problem in that wear dust fell on the fixed contacts, which gave rise to contact defects, because the protruding portion and the air gap were formed on a trajectory, along which a movable contact moved linearly forward and backward.

SUMMARY OF THE INVENTION

An object of the invention is to remove the contact defects due to carbonization of resin material, of which a terminal plate is made, produced by generation of an arc and wear dust of resin. This object is achieved by providing a sliding switch constructed such that only portions contacting with fixed contacts in a movable contact plate are brought into contact with portions contacting with a movable contact in fixed contact plates.

According to one aspect of the present invention, in order to solve the problem of the prior art techniques described above, a sliding switch is provided that comprises a terminal plate provided with fixed contact plates and a movable plate provided with a movable contact plate, which is selectively brought into contact with the fixed contact plates, wherein each of the fixed contact plates has a fixed contact protruding from a surface of the terminal plate and at least a pair of protrusions are formed on two sides of the movable contact plate.

According to another aspect of the present invention, the movable contact plate is formed approximately in a U shape, and two pairs of protrusions are formed on the two sides of a bottom surface at a front extremity portion and a rear extremity portion thereof, respectively.

According to another aspect of the invention, a relation of L4>L2 is valid wherein L4 is a distance between each pair of the protrusions, and L2 is a transversal width of the fixed contact plates.

According to another aspect of the invention, a relation H1>H2 is valid wherein H1 is a height protruding upward of the fixed contacts, and H2 is a height of protrusions protruding downward from the bottom surface of the movable contact plate.

According to another aspect of the invention, an air gap is formed between the fixed contact plates in the terminal plate.

According to another aspect of the invention, a protruding portion, which the protrusion of the movable contact plate should surmount, is formed on the surface of the terminal plate on both sides of the air gap.

According to another aspect of the invention, the protruding portion is disposed in a transversal direction approximately in a semicylindrical shape, and a relation H1>H3 is valid wherein H3 is a height of the protruding portion, and H1 is a height of the fixed contacts.

According to another aspect of the invention, a sliding switch is provided that comprises a terminal plate provided with fixed contact plates; a movable contact plate having movable contact portions, which are brought into contact with the fixed contact plates; and a movable plate provided with the movable contact plate, the fixed contact plates are disposed opposite to each other on the terminal plate, a protruding portion protruding from a surface of the terminal plate is formed between the fixed contact plates, adjacent thereto, and a sliding contact portion sliding on the protruding portion at an OFF position is formed on the movable contact plate.

According to another aspect of the invention, an air gap is formed in a direction of the OFF position of the fixed contact plates disposed on the surface of the terminal plate.

According to another aspect of the invention, the sliding contact portion is formed between the movable contact portions on the movable contact plate, the sliding contact portion being in a state where it is contacted with pressure with the protruding portion at an OFF position and it floats over the surface of the terminal plate at an ON position.

According to another aspect of the invention, a relation H5>H4 is valid wherein H4 is a height of the sliding contact portion from the surface of the terminal plate, and H5 is a height of the protruding portion.

According to another aspect of the invention, a metal plate is disposed on the terminal plate on the side of the OFF position with respect to the protruding portion, and a sliding portion, which is always slidably contacted with the metal plate, is formed at an extremity portion of a bottom surface of the movable contact plate.

According to another aspect of the invention, the metal plate and the fixed contact plates are formed by inserting a conducting metal plate material into the terminal plate, and thereafter, they are separated from each other by press processing.

DETAILED DESCRIPTION OF THE PREFERRED EMBODIMENTS

Figure 1:
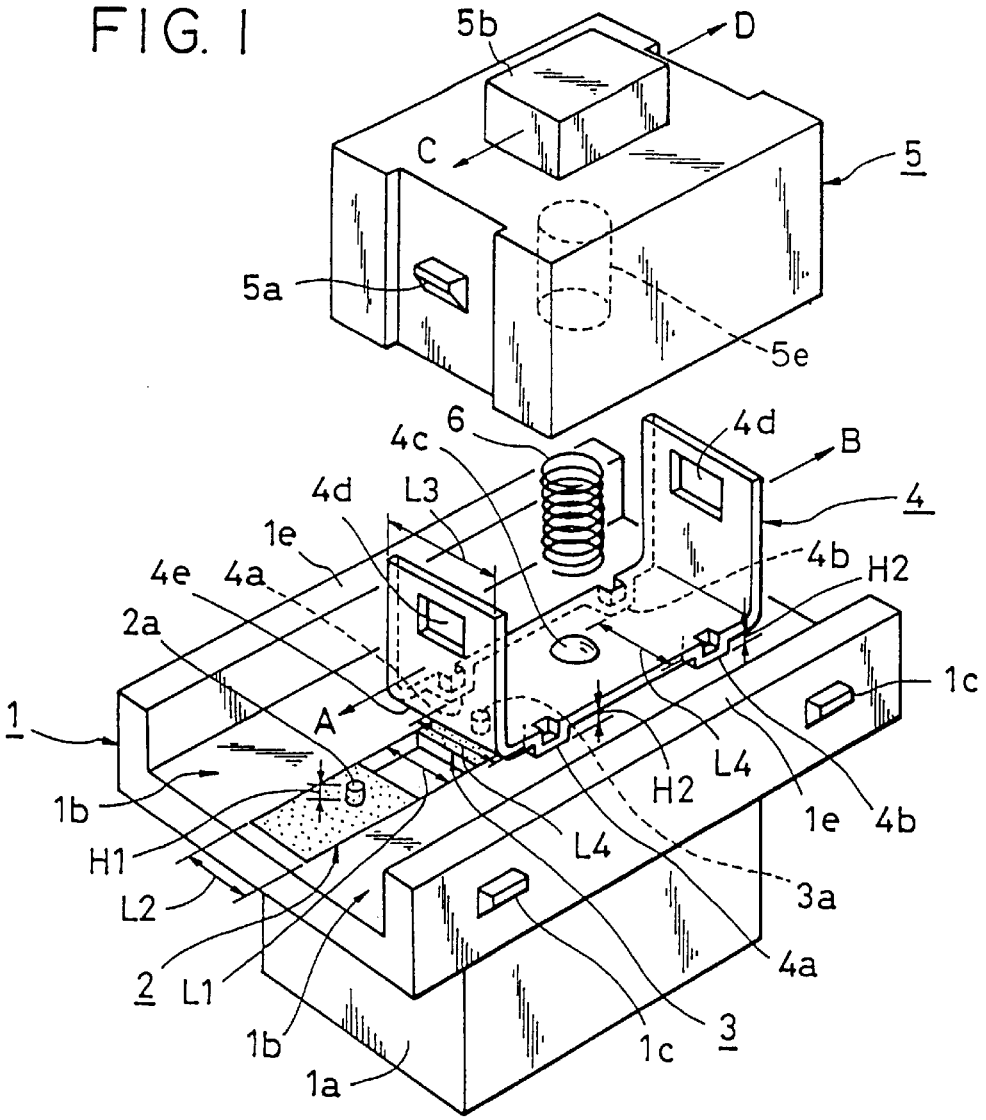
FIG. 1 is an exploded and enlarged perspective view of a principal part of a sliding switch according to a first embodiment of the present invention.

A first embodiment of the present invention will now be explained in detail, referring to FIGS. 1, 2 and 3. In the figures, reference numeral I represents a terminal plate, in which fixed contact plates 2 and 3 are formed by insertion with a resin. A connector 1*a* is formed on a lower surface of the terminal plate 1 in one body. The fixed contact plates 2 and 3 are exposed on an upper surface 1*b* thereof, and projections 1*c* are formed on side surfaces. Engaging holes formed in a case (not shown in the figures) are engaged with the projections 1*c*.

An air gap 1*d*, in which wear dust produced by a movable contact plate 4 sliding on the terminal plate 1 while being in contact therewith falls to be stored, is formed on the surface 1*b* of the terminal plate between the fixed contact plate 2 and the fixed contact plate 3. The air gap 1*d* has a width L1, which is equal to a width L2 of the fixed contact plates 2 and 3. A depth of the air gap 1*d* is not specifically restricted. Side walls 1*e* are formed on both sides of the surface 1*b* of the terminal plate for guiding sliding movement of a movable plate 5. The side walls 1*e* may be inner walls of the case. The projections 1*c* are engaged elastically with the engaging holes (not shown) formed in the neighborhood of the opening end of the case so as to engage the terminal plate 1 with the case.

The fixed contact plates 2 and 3 are conductive metal plates having a same shape, disposed at both ends of the air gap 1*d*. Fixed contacts 2*a* and 3*a* are disposed at the centers of the fixed contact plates 2 and 3, respectively, and protrude therefrom. The fixed contacts 2*a* and 3*a* are formed approximately on a center line of the fixed contact plates 2 and 3, along which a movable contact plate 4 is moved slidingly. The fixed contacts 2*a* and 3*a* are formed in an inversed receptacle shape, for example, by press processing, or the like. The following relation:

$H1>H2$ is valid, where H1 represents the height of the fixed contacts 2*a* and 3*a*, and H2 indicates the height of protrusions 4*a* and 4*b* formed on the movable contact plate 4.

The movable contact plate 4 is a conductive metal plate formed approximately in a U shape, for example, as indicated in FIG. 1, and protrusions 4*a* and 4*b* are formed downward on the lower surface thereof at four positions at front and rear end portions on both sides. A spring holding protrusion 4*c* protrudes upward on the movable contact plate 4 at the middle point of the four protrusions 4*a* and 4*b*. Engaging holes 4*d* engaged with engaging projections 5*a* are formed on a movable plate 5 at right and left end portions. The movable contact plate 4 is mounted on the movable plate 5 through a contact spring 6 by engaging the engaging projections 5*a* with the engaging holes 4*d*. The following relations:

$L1<L3$ and $L2<L3$ are valid, where L3 is the transversal width of the movable contact plate, L2 is the width of the fixed contact plates 2 and 3, and L1 is the width of the air gap 1*d*.

The protrusions 4*a* and 4*b* are formed so as to protrude downward by press processing, or the like, on the lower surface of the movable contact plate 4 at the front and rear end portions on both sides. The following relation:

$H2<H1$ is valid, where H2 represents the height of the protrusions 4*a* and 4*b*, and H1 indicates the height of the fixed contacts 2*a* and 3*a*.

The following further relations:

$L2<L4$ and $L1<L4$ are valid, where L4 represents the distance between the protrusions 4*a* at the front portion as well as between the protrusions 4*b* at the rear portion; and L2 and L1 indicate the width of the fixed contact plate 2, 3 and the width of the air gap 1*d*, respectively. The width L2 of the fixed contact plates 2 and 3 is approximately equal to the width L1 of the air gap 1*d*.

The spring holding protrusion 4*c* holds the lower end of a contact spring 6 made of, for example, a compression coil spring and protrudes in a semispherical shape, as indicated in FIG. 1. In the case where only one contact spring 6 is used, the spring holding protrusion 4*c* is formed at the center of the movable contact plate 4. In the case where two contact springs 6 are used, two spring holding protrusions 4*c* are formed on the center line of the movable contact plate 4.

The movable plate 5 is disposed slidably in directions indicated by arrows C and D between the terminal plate 1 and the case. A knob 5*b* is formed, for example, in one body with the movable plate 5. The knob 5*b* may be made also of a material different from the movable plate 5. A blind hole 5*e* is provided, into which the upper end of the contact spring 6 is inserted to be held.

The first embodiment of the present invention is constructed as described above, and now the operation thereof will be explained in detail. For example, in the case where the movable plate 5 is moved in the direction indicated by the arrow D, as shown in FIGS. 1 to 3, and the movable contact plate 4 is at an OFF position (a state where it is moved in the direction indicated by the arrow B), only the fixed contact 3*a* is in contact with the bottom surface 4*e* of the movable contact plate 4. Since the fixed contact 3*a* is in contact with the bottom surface 4*e*, as indicated in FIG. 3, the protrusions 4*a* on the front side are in a state where they are separated from the surface 1*b* of the terminal plate. On the contrary, the protrusions 4*b* on the rear side are in contact with the surface 1*b* with pressure.

When the knob 5*b* is moved in the direction indicated by the arrow C, the movable contact plate 4 is slid in the direction indicated by the arrow A. The protrusions 4*a* on the front side proceed from a position on the surface 1*b* where they are on both sides of the fixed contact plate 3, to a position on the surface 1*b* where they are on both sides of the air gap 1*d*, and further to a position on the surface 1*b* where they are on both sides of the fixed contact plate 2, where they are stopped at an ON position. The protrusions 4*b* on the rear side proceed from a position on the surface 1*b* where they are on both sides of the fixed contact plate 3 in the direction indicated by the arrow A, and stop at a position where they are on both sides of the fixed contact plate 3 in the neighborhood of the air gap 1*d*.

Figure 2:
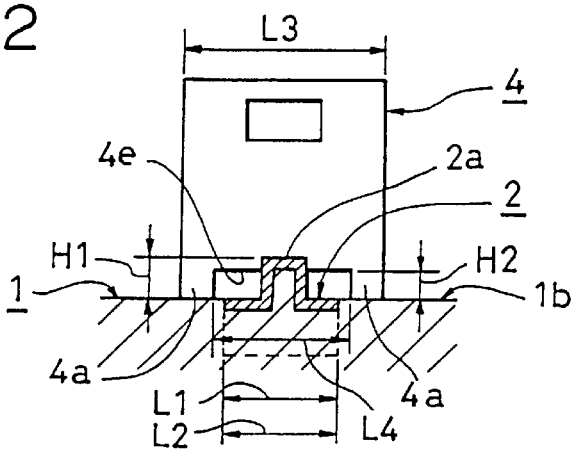
FIG. 2 is an enlarged partial cross-sectional view of a principal part according to the first embodiment of the present invention.
Figure 3:
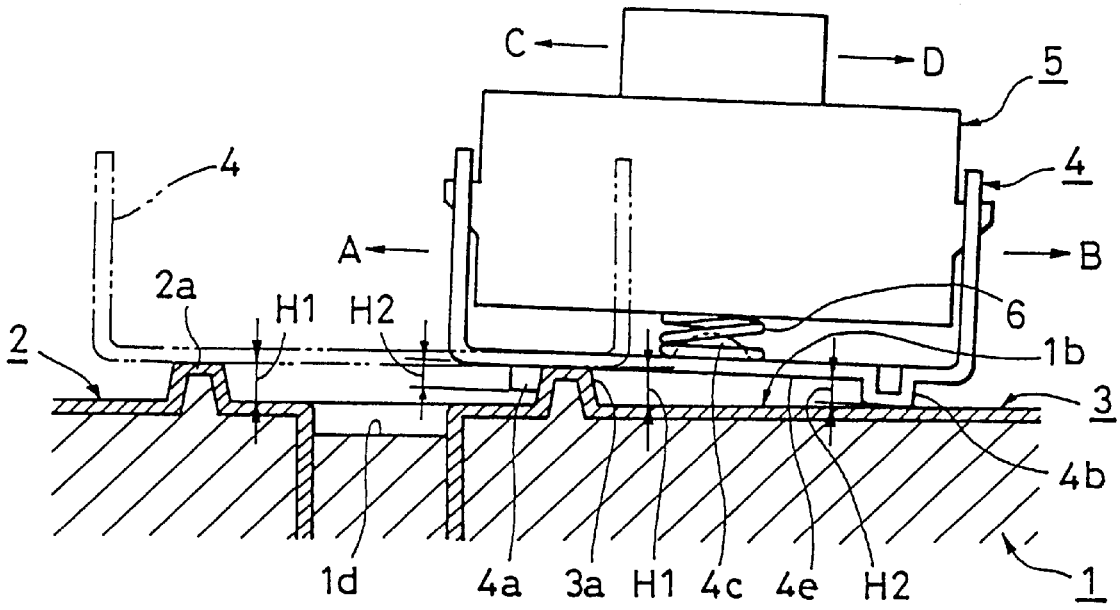
FIG. 3 is another enlarged partial cross-sectional view of the principal part according to the first embodiment of the present invention.

Only the fixed contact 3*a* is in contact with the bottom surface 4*e* of the movable contact plate 4 at the OFF position indicated in FIGS. 1 to 3. When the fixed contact plate 4 is moved in the direction indicated by the arrow A, the bottom surface 4*e* slides on the fixed contact 3*a*, passes through over the air gap 1*d*, and is brought into contact with the fixed contact 2*a* to turn-on the switch.

When the movable contact plate 4 is turned on, a portion of the bottom surface 4*e* on the side where the arrow A is written runs on the fixed contact 2*a,* and a portion of the bottom surface 4*e* on the side where the arrow B is written is on the fixed contact 3*a*. Since the height H1 of the fixed contacts 2*a* and 3*a* is greater than the height H2 of the protrusions 4*a* and 4*b,* the protrusions 4*a* and 4*b* are separated from the surface 1*b* so as to be in a floating state. The fixed contact plates 2 and 3 are in contact with the bottom surface 4*e* of the movable contact plate 4 only at the fixed contacts 2*a* and 3*a*. The protrusions 4*a* and 4*b* slide on the surface 1*b* of the terminal plate 1 made of resin.

When the bottom surface 4*e* of the movable contact plate 4 is brought into contact with both the fixed contacts 2*a* and 3*a,* the switch is turned on and an arc is produced. At this time, since the movable contact plate 4 runs on the fixed contacts 2*a* and 3*a,* as described previously, in a state where the protrusions 4*a* and 4*b* are separated from the surface 1*b* of the terminal plate, the surface 1*b* made of resin is prevented from being carbonized. Further, since the protrusions 4*a* and 4*b* are not brought into contact with the fixed contact plates 2 and 3, contact defects, and the like, can be prevented. Since the movable contact plate 4 is brought into contact only with the fixed contacts 2*a* and 3*a,* good switching on and off can be effected.

The movable contact plate 4 described previously may be a sliding contact piece, a brush, or the like made of conductive plate spring material, one end of which is secured to the movable plate. In this case, in lieu of the protrusions 4*a* and 4*b,* only a protrusion 4*a* on the front side and on the other end side is formed.

Figure 4:
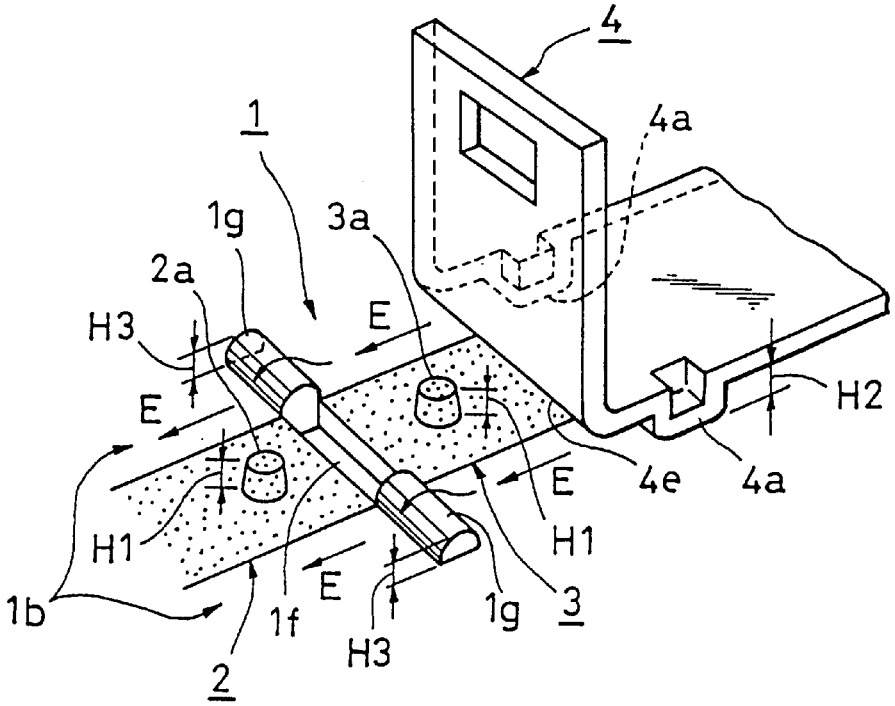
FIG. 4 is an enlarged partial perspective view showing a second embodiment of the present invention.

Now a second embodiment of the present invention will be explained in detail, referring to FIG. 4. Parts in the second embodiment that are common to those used in the first embodiment are indicated by the same signs or reference numerals, and further explanation thereof will be omitted. In the second embodiment of the present invention, an air gap 1*f* is formed, which is narrower than the air gap 1*b* between the fixed contact plate 2 and the fixed contact plate 3 in the first embodiment, and two protruding portions are formed on both sides of the air gap 1*f*.

The fixed contact plates 2 and 3 are formed by inserting them into the terminal plate 1 with resin, and the air gap 1*f* is formed between the fixed contact plates 2 and 3. The air gap 1*f* is a blind hole formed between the fixed contact plate 2 and the fixed contact plate 3, as indicated in FIG. 4. The protruding portions are approximately semicylinders formed on the right and left sides of the air gap 1*f*. The fixed contact plate 2 and the fixed contact plate 3 are disposed on the front and rear sides of the air gap 1*f,* respectively.

The fixed contact plates 2 and 3, as well as the movable contact plate 4, are identical to the corresponding parts used in the first embodiment of the present invention. When the switch is turned on or off, the protrusions 4*a* slide on the surface 1*b* of the terminal plate on both sides of the fixed contact plates 2 and 3 and the air gap 1*f* and run on the protruding portions 1*g*.

The following relations:

H1>H2 and

H1>H3 are valid, where H1 is the height of the fixed contacts 2*a* and 3*a,* H2 is the height of the protrusions 4*a,* and H3 is the height of the protruding portions 1*g*.

The following relation:

L1<L4 is also valid, similar to the first embodiment, where L4 is the distance between the protrusions 4*a* and 4*b,* and L1 is the width of the fixed contact plates 2 and 3.

The second embodiment of the present invention is constructed as described above, and now the operation thereof will be described in detail. For example, as indicated in FIG. 4, in the case where the movable contact plate 4 is at the OFF position, the protrusions 4*a* and 4*b* of the movable contact plate 4 are in contact with the surface 1*b* of the terminal plate 1*b* with pressure, and the fixed contact plates 2 and 3 are not in contact with the movable contact plate 4.

When the movable contact plate 4 is moved in a direction indicated by an arrow E by manipulating the knob, the protrusions 4*a* slide in the direction indicated by the arrow E on the surface 1*b* on both the outer sides of the fixed contact plate 3. At first, the bottom surface 4*e* of the movable contact plate 4 is brought into contact with the fixed contact 3*a* to be raised. Next, the protrusions 4*a* run on the protruding portions 1*g* to be raised. Then, when the protrusions 4*a* surmount the protruding portions 1*g* and descend, the bottom surface 4*e* of the movable contact plate 4 is brought into contact with the fixed contact 2*a* to turn-on the switch, and the movable contact plate 4 is stopped.

When the switch is turned on, the bottom surface 4*e* of the movable contact plate 4 runs on both the fixed contacts 2*a* and 3*a*. At this time, the following relation:

H1>H2 is valid, where H1 is the height of the fixed contacts 2*a* and 3*a,* and H2 is the height of the protrusions 4*a*. Since the height H1 of the fixed contacts 2*a* and 3*a* is greater than the height H2 of the protrusions 4*a,* the protrusions 4*a* are separated from the surface 1*b* and are in a floating state.

When the bottom surface 4*e* of the movable contact plate 4 is brought into contact with both the fixed contacts 2*a* and 3*a,* the switch is turned on, and an arc is produced. At this time, since the movable contact plate 4 runs on the fixed contacts 2*a* and 3*a,* as described previously, in a state where the protrusions 4*a* are separated from the surface 1*b* of the terminal plate, the surface 1*b* made of resin is prevented from being carbonized. Further, since the protrusions 4*a* are not brought into contact with the fixed contact plates 2 and 3, contact defects, and the like, can be prevented. Since the movable contact plate 4 is brought into contact only with the fixed contacts 2*a* and 3*a,* good switching on and off can be effected.

Next, a third embodiment of the present invention will be described in detail, referring to FIGS. 5 to 10. In the third embodiment of the present invention, the bottom surface of the movable contact plate is formed approximately in a triangular shape. Hereinbelow, a mode of realization where the present invention is applied to a hazard switch for a vehicle will be described in detail as the third embodiment.

Figure 5:
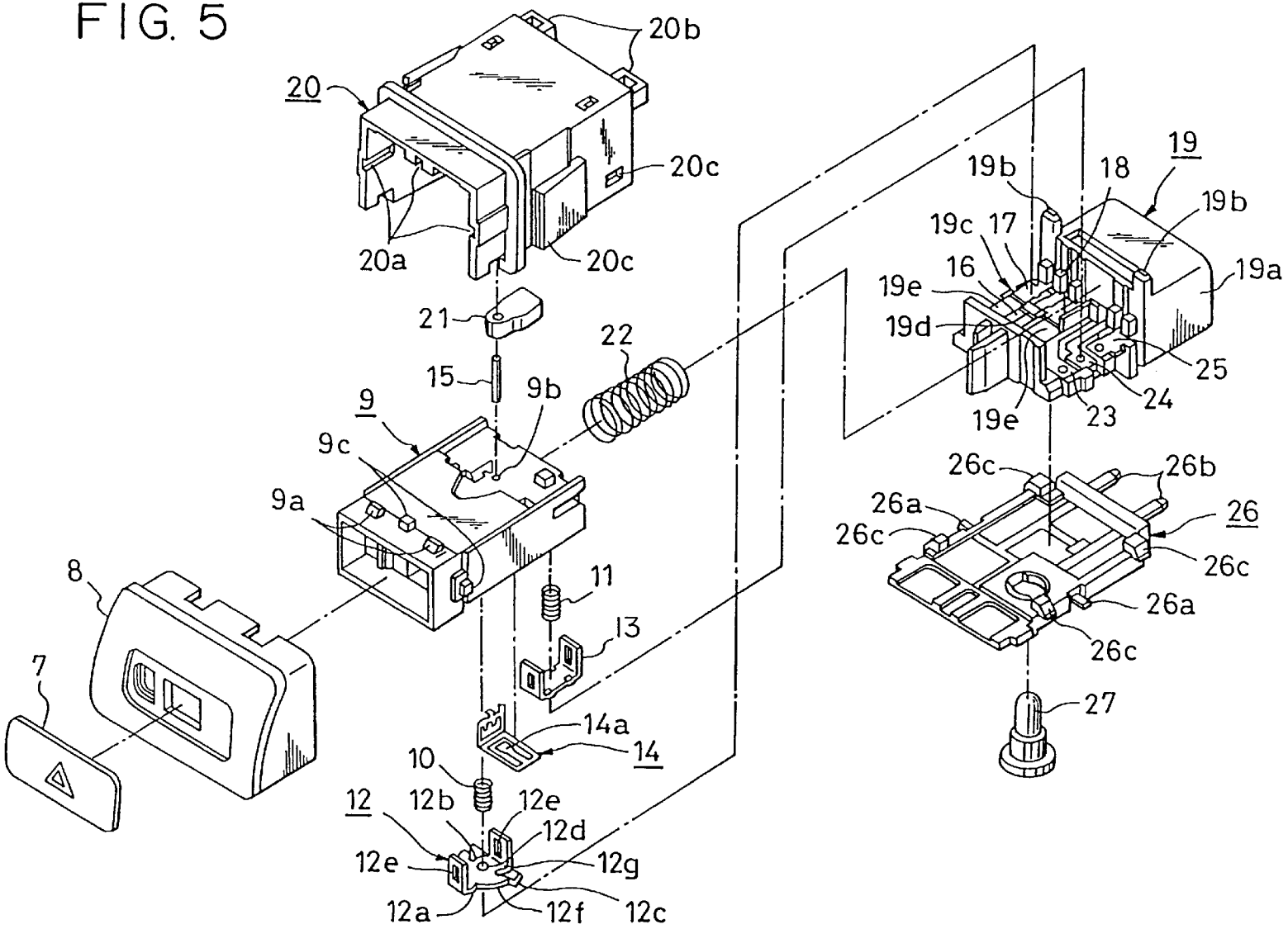
FIG. 5 is an exploded perspective view showing a third embodiment of the present invention.

In FIG. 5, reference numeral 7 is a nameplate secured to a knob, in which functions of the knob 8 are described. The nameplate 7 is, for example, a mark for a hazard switch for a vehicle. The knob 8 is engaged with a movable plate 9 through projections 9*a*. The movable plate 9 is inserted movably between a case 20 and a first terminal plate 19 and energized by a spring 22. The movable plate 9 holds movable contacts 12 and 13 as well as a plate spring 14 through contact springs 10 and 11, respectively, on a lower surface thereof. Further, a lock pin 15 is inserted into a through hole 9*b* formed in the movable plate 9. Guiding protrusions 9*c* which are inserted into guiding grooves 20*a* formed in an opening end portion of the case 20.

The movable contact plate 12 is a sliding contact member formed approximately in a U shape having a protruding piece, in which an engaging hole 12*e* is formed. The movable contact plate 12 has a bottom surface 12*f,* which is approximately triangular. The movable contact plate 12 includes a sliding portion 12*a,* which is always on a metal plate 16; movable contact portions 12*b* and 12*c,* which are brought into contact with fixed contact plates 17 and 18, respectively; and a sliding portion 12*g,* which slides on a protruding portion 19*d* of the first terminal plate 19. The movable contact plate 12 is mounted on the movable plate 9 by engaging the engaging hole 12*e* with one of the guiding protrusions 9*c* through the contact spring 10 (see, for example, FIGS. 8 to 10). A protruding portion 12*d* having an approximately semispherical shape holds a lower end portion of the contact spring 10. The movable contact plate 12 has the sliding portion 12*a* at an apex of the approximately triangular bottom surface 12*f,* the movable contact portions 12*b* and 12*c* at right and left end portions thereof; and the sliding contact portions 12*g* between the movable contact portion 12*b* and the movable contact portion 12*c*.

The movable contact plate 13 has a shape different from that of the movable contact plate 12, for example, as indicated in FIG. 5. The movable contact plate 13 is a movable contact member having, for example, a shape described in detail in the first embodiment of the present invention. The movable contact plate 13 is held on the lower surface of the movable plate 9 through the contact spring 11.

The plate spring 14 is secured to the lower surface of the movable plate 9 at one end portion thereof and has an elastically pressing piece 14*a* energizing the lock pin 15 approximately at the center thereof. The lock pin 15 energized by the elastically pressing piece 14*a* is contacted with pressure with a cam surface of a heart cam mounted on the case 20 at an upper end thereof to hold the movable plate 9 at an ON position or at an OFF position.

The first terminal plate 19 includes the metal plate 16, with which the sliding portion 12*a* of the movable contact plate 12 is brought into contact; the fixed contact plates 17 and 18, with which the movable contact portions 12*b* and 12*c* of the movable contact plate 12 are brought into contact, respectively; fixed contact plates 23, 24 and 25, with which the movable contact plate 13 is brought into contact; and a connector portion 19*a* formed in one body with resin. As indicated in FIGS. 5 and 6, the fixed contact plates 17 and 18, with which the two movable contact portions 12*b* and 12*c* are brought into contact, respectively, are disposed on the surface 19*c* of the first terminal plate 19 with a predetermined interval.

The protruding portion 19*d* is formed on a trajectory of the sliding portion 12*g* between the fixed contact plates 17 and 18 at a position where the movable contact portions 12*b* and 12*c* are switched from OFF to ON. An air gap 19*e* is formed on trajectories of the movable contact portions 12*b* and 12*c* at a position adjacent to the fixed contact plates 17 and 18 on both sides of the metal plate 16.

Figure 6:
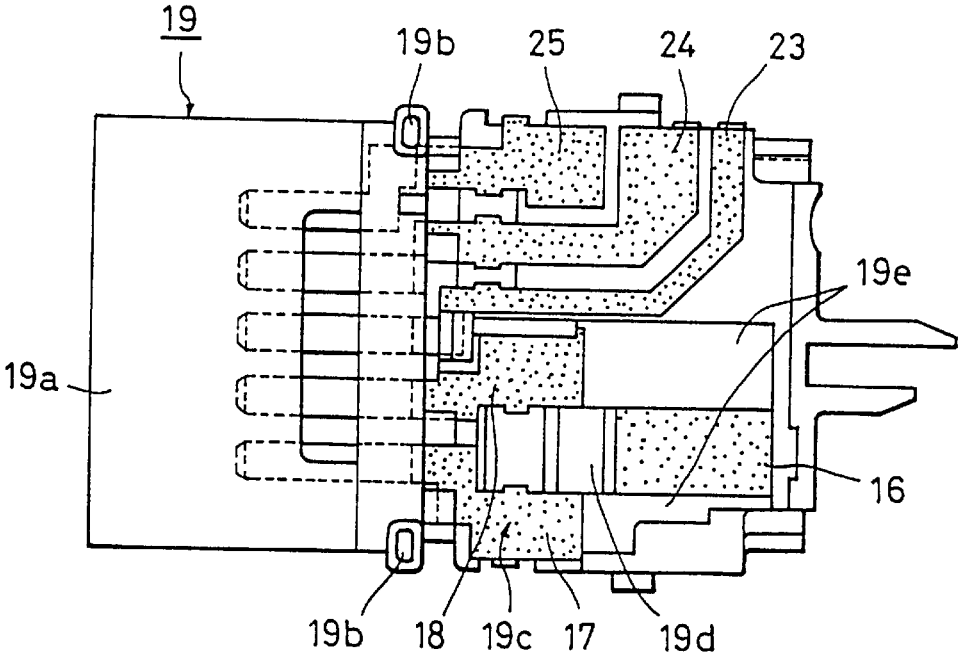
FIG. 6 is a plan view of a first terminal plate according to the third embodiment of the present invention.
Figure 7:
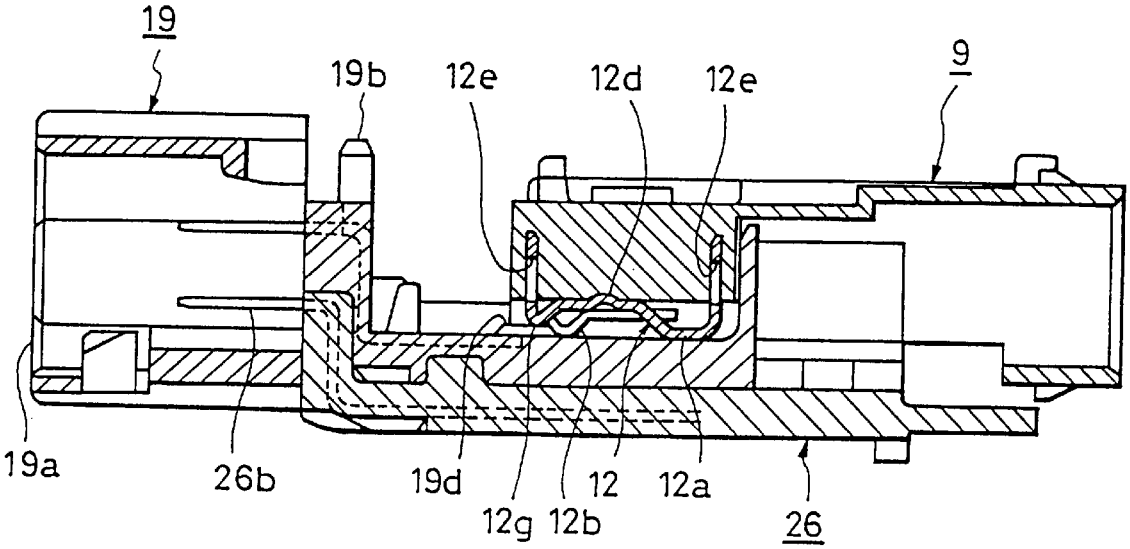
FIG. 7 is a transversal cross-sectional view, in which a movable plate, the first terminal plate and a second terminal plate are mounted together, according to the third embodiment of the present invention.

The metal plate 16, with which the sliding portion 12*a* is always contacted slidably, is disposed at a position on an extension line between the fixed contact plate 17 and the fixed contact plate 18, as indicated in FIGS. 5 and 6. The protruding portion 19*d,* with which the sliding portion 12*g* is contacted with pressure at the OFF position, is disposed between the fixed contact plate 17 and the fixed contact plate 18, adjacent to the metal plate 16. The fixed contact plates 17 and 18 are disposed at positions opposite to each other through the protruding portion 19*d.*

Figure 8:
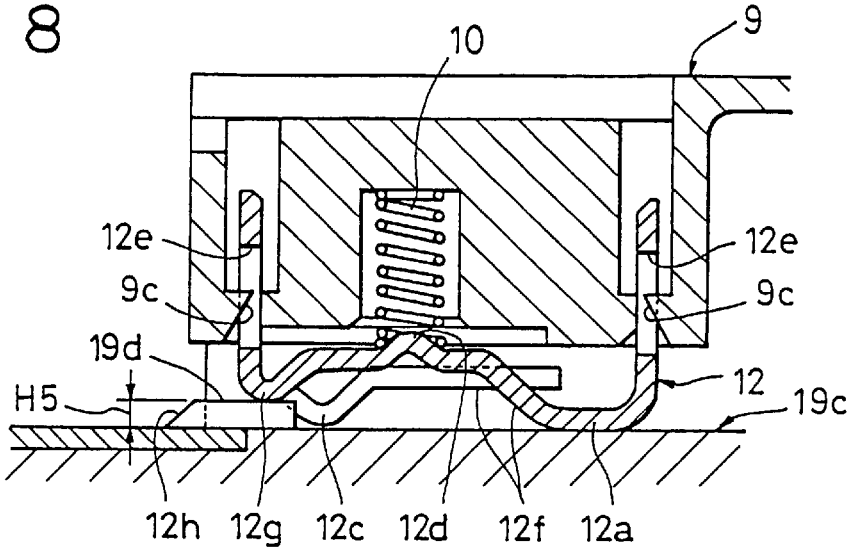
FIG. 8 is an enlarged cross-sectional view of a principal part indicating a state where it is at an OFF position, according to the third embodiment.
Figure 9:
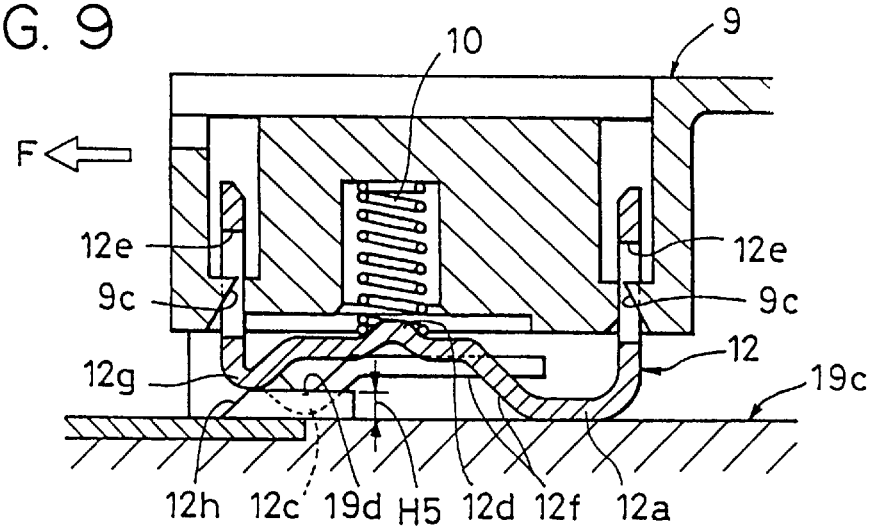
FIG. 9 is an enlarged cross-sectional view of the principal part indicating a state where it moves from the OFF position to an ON position, according to the third embodiment of the present invention.
Figure 10:
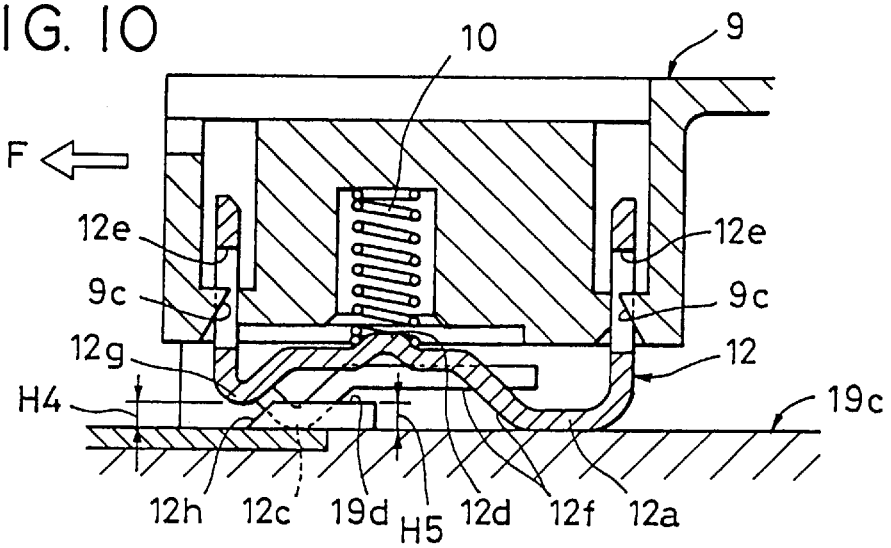
FIG. 10 is an enlarged cross-sectional view of the principal part indicating a state where it is at the ON position, according to the third embodiment.

As indicated in FIGS. 8 to 10, the movable contact plate 12 sliding on the surface 19*c* of the movable plate is so formed that the sliding portion 12*a,* the movable contact portion 12*b* and the movable contact plate 12*c* are at a same height with respect to the surface 19*c*. In the sliding portion 12*g* of the movable contact plate 12, as indicated in FIG. 10, the following relation:

$$H4<H5$$

is valid, where H4 is the height of the sliding portion, and H5 is the height of the protruding portion 19*d.* That is, the height H5 of the protruding portion 19*d* is slightly greater than the height H4 of the sliding portion 12*g*. The protruding portion 19*d* is at such a position with such a length that the sliding portion 12*g* is contacted slidably therewith, when the movable contact plate 12 is at the OFF position. The width of the protruding portion 19*d* is almost equal to the width of the metal plate 16, as indicated in FIG. 5.

The movable contact plate 12 and the movable contact plate 13 disposed on the movable plate 9 are disposed slidably on the upper surface of the first terminal plate 19. A second terminal plate 26, on which a lamp 27 is mounted, is disposed on the lower surface of the first terminal plate 19. The second terminal plate 26 is secured to the first terminal plate 19 by inserting a terminal 26*b* into the connector portion 19*a* from the back side and by securing connecting pieces 26*a* to the movable plate 9 by caulking. The connecting pieces 26*a* are made of a same conductive metal plate as the terminals 26*b*. The connecting pieces 26*a* are formed by insertion into the second terminal plate 26 and protrude from the two side surfaces of the second terminal plate 26.

The metal plate 16 and the fixed contact plates 17 and 18 are formed, starting from a conductive metal plate, by separating them from each other by press processing. The sliding portion 12*a* of the movable contact plate 12 is always on the metal plate 16 and slides thereon. The fixed contact plates 17 and 18 are contacts, with which the two movable contact portions 12*b* and 12*c* of the movable contact plate 12 are brought into contact, respectively, and which are disposed opposite to each other with a predetermined interval, as indicated in FIG. 5. The fixed contact plate 17 is a contact, with which the movable contact portion 12*b* is brought into contact, when the movable contact plate 12 is moved to the ON position. The fixed contact plate 18 is a contact, with which the movable contact portion 12*c* is brought into contact, when the movable contact plate 12 is moved to the ON position.

Engaging holes 20*b,* with which protrusions 19*b* protruding upward from the first terminal plate 19 are engaged, are formed in an end portion of the case 20. On the other hand, engaging holes 20*c,* with which protrusions 26*c* protruding from the side surfaces of the second terminal plate 26 are engaged, are formed on the two side surfaces of the case 20. The heart cam 21 is secured to the inner wall surface of the case 20. The case 20 is mounted by putting the lock pin 15, the movable plate 9, the contact springs 10 and 11, and the movable contact plates 12 and 13 between the first terminal plate 19 and the case 20, by engaging the protrusions 19*b* with the engaging holes 20*b* and by engaging the protrusions 26*c* of the second terminal plate 26 with the engaging holes 20*c*.

The third embodiment of the present invention is constructed as described above, and operations thereof will now be described in detail. For example, in the case where the movable contact plate 12 is at the OFF position, as indicated in FIG. 8, the sliding portion 12*g* of the movable contact plate 12 is contacted with pressure with the protruding portion 19*d,* and the movable contact portion 12*b* and the movable contact portion 12*c* are at positions over the air gap 19*e*. The sliding portion 12*a* is on the metal plate 16.

Starting from this OFF position, when the knob 8 is pushed, as indicated in FIG. 9, the movable plate 9 is moved in the ON direction, as indicated by the arrow F, the sliding contact portion 12*g* slides on the protruding portion 19*d,* and the sliding portion 12*a* slides on the metal plate 16. The movable contact portions 12*b* and 12*c* are at positions slightly separated from the surface 19*c* of the terminal plate.

When the movable plate 9 is moved further in the direction indicated by the arrow F so that the sliding contact portion 12*g* surmounts the protruding portion 19*d,* it descends along a slope 12*h*. Then, the fixed contact portions 12*b* and 12*c* descend also and are brought into contact with the fixed contact plates 17 and 18, respectively, so that the switch is turned on. The sliding portion 12*a* slides on the metal plate 16. In this way, the lock pin 15 is brought into contact with the heart cam 21, and the ON state is maintained. The sliding contact portion 12*g* is in a floating state where it is separated from the surface 19*c*.

When the knob 8 is manipulated by pushing it with pressure, the movable contact plate 12 is released from the ON state indicated in FIG. 10 to return to the OFF state indicated in FIG. 8.

When the movable contact portions 12*b* and 12*c* are brought into contact with the fixed contact plates 17 and 18, respectively, the switch is turned on, and an arc is produced. At this time, since the sliding portion 12*a* of the movable contact plate 12 is on the metal plate 16, the movable contact portion 12*b* is on the fixed contact portion 17, and the movable contact portion 12*c* is on the fixed contact portion 18, as described previously, it is possible to prevent the surface 19*c* of the terminal plate made of resin from being carbonized, because the sliding portion 12*a* and the movable contact portions 12*b* and 12*c* are not brought into contact. Further, since only the sliding contact portion 12*g* is brought into contact with the protruding portion 19*d* on the surface 19*c* of the terminal plate made of resin and the movable contact portions 12*b* and 12*c* are not brought into contact therewith, contact defects, and the like can be prevented.

Since the present invention is constructed as described above, the following effects can be obtained.

According to a first aspect of the invention, a sliding switch is provided comprising a terminal plate provided with fixed contact plates and a movable plate provided with a movable contact plate, which is selectively brought into contact with the fixed contact plates, each of the fixed contact plates has a fixed contact protruding from a surface of the terminal plate, and at least a pair of protrusions are formed on the two sides of the movable contact plate. With this construction, it is possible to prevent wear dust produced by sliding of the movable contact plate from sticking to the fixed contacts, thereby preventing contact defects, and preventing the terminal plate from being carbonized.

According to another aspect of the invention, since the movable contact plate is formed approximately in a U shape and two pairs of protrusions are formed on the two sides of a bottom surface at a front extremity portion and a rear extremity portion thereof, respectively, positions on the bottom surface of the movable contact plate, which are brought into contact with the fixed contacts, are not brought into contact with any points other than the fixed contacts and, thus, it is possible to prevent wear dust, and the like from sticking thereto.

According to another aspect of the invention, since a relation L4>L2 is valid, where L4 is a distance between each pair of the protrusions, and L2 is a transversal width of the fixed contact plates, the protrusions slide only on the surface of the terminal plate made of resin and, thus, contact defects are prevented.

According to another aspect of the invention, since a relation H1>H2 is valid, where H1 is a height protruding upward of the fixed contacts, and H2 is a height protruding downward from the bottom surface of the movable contact plate, the protrusions are separated from the surface of the terminal plate when the movable contact plate is brought into contact with the fixed contact. Thus, it is possible to prevent the surface from being carbonized when an arc is produced.

According to another aspect of the invention, since an air gap is formed between the fixed contact plates in the terminal plate, wear dust produced by the sliding movable contact plate falls in the air gap and, in this way, contact defects are prevented.

According to another aspect of the invention, a protruding portion, which the protrusions of the movable contact plate should surmount, is formed on the surface of the terminal plate on both sides of the air gap, and the movable contact plate is separated from the surface of the terminal plate just before the movable contact plate is brought into contact with one of the fixed contacts. Thus, resin in a surface portion of the terminal plate is prevented from being carbonized by an arc.

According to another aspect of the invention, since the protruding portion is disposed in a transversal direction approximately in a semicylindrical shape, and a relation H1>H3 is valid, where H3 is a height of the protruding portion, and H1 is a height of the fixed contacts, the bottom surface of the movable contact plate is brought into contact with one of the fixed contacts when the protrusions of the movable contact plate surmount the protruding portion. In this way, it is possible to effect a good switching on and off.

According to another aspect of the invention, a sliding switch is provided comprising a terminal plate provided with fixed contact plates; a movable contact plate having movable contact portions, which are brought into contact with the fixed contact plates; and a movable plate provided with the movable contact plate, the fixed contact plates are disposed opposite to each other on the terminal plate; a protruding portion protruding from a surface of the terminal plate is formed between the fixed contact plates, adjacent thereto; and a sliding contact portion sliding on the protruding portion at an OFF position is formed on the movable contact plate, when the movable contact plate is moved from the OFF position to the ON position. With this construction, the sliding contact portion is held in a stable state where it is possible to have the movable contact portions contact only with the respective fixed contact plates. In this way, it is possible to prevent contact defects due to wear dust and to prevent the movable contact plate from being brought into contact with resin in the surface portion of the terminal plate when the switch is turned on, and to prevent the resin from being carbonized by an arc.

According to another aspect of the invention, since an air gap is formed in a direction of the OFF position of the fixed contact plates on the surface of the terminal plate, wear dust produced by the sliding movable contact plate falls in the air gap and, in this way, contact defects are prevented.

According to another aspect of the invention, owing to the fact that the sliding contact portion is formed between the movable contact portions on the movable contact plate, the sliding contact portion being in a state where it is contacted with pressure with the protruding portion at an OFF position and it floats over the surface of the terminal plate at an ON position, the surface portion of the terminal plate made of resin is prevented from being carbonized by an arc.

According to another aspect of the invention, since a relation H5>H4 is valid, where H4 is a height of the sliding contact portion from the surface of the terminal plate, and H5 is a height of the protruding portions, the sliding contact portion is held in a stable state, where the movable contact portions are brought into contact only with the respective fixed contact plates when the movable contact plate is moved from the OFF position to the ON position. In this way, resin portions are protected against an arc.

According to another aspect of the invention, a metal plate is disposed on the terminal plate on the side of the OFF position with respect to the protruding portions, and a sliding portion, which is always slidably contacted with the metal plate, is formed at an extremity portion of a bottom surface of the movable contact plate. Since the sliding portion of the movable contact plate always slides on the metal plate, resistance of the sliding portion to wear is improved, and thus, it is possible to decrease generation of wear dust.

According to another aspect of the invention, the metal plate and the fixed contact plates are formed by inserting a conductive metal plate material into the terminal plate, and thereafter they are separated from each other by press processing. As a result, it is possible to dispose the metal plate on the terminal plate without increasing the number of fabrication steps, and to utilize the conductive metal plate material with a high efficiency.

What is claimed is:

1. A contact structure of a sliding switch comprising:

a terminal plate provided with fixed contact plates; and a moveable plate provided with a movable contact plate, which is selectively brought into contact with said fixed contact plates, wherein each of said fixed contact plates has a fixed contact, producing above an upper surface of the terminal plate, and said movable contact plate is formed approximately in a U shape with an upstanding front wall and an upstanding rear wall, and two pairs of downwardly extending protrusions are formed on each of two sides of a bottom surface of the movable contact plate at a front extremity portion and a rear extremity portion thereof, respectively, to form a lowermost portion of the movable contact plate.

2. A contact structure of a sliding switch according to claim 1, wherein a relation L4>L2 exists, where L4 is a distance between each pair of said protrusions, and L2 is a transversal width of said fixed contact plates.

3. A contact structure of a sliding switch according to claim 2, wherein a relation H1>H2 exists, where H1 is a height protruding upward of said fixed contacts, and H2 is a height of protrusions protruding downward from said bottom surface of said movable contact plate.

4. A contact structure of a sliding switch according to claim 3, wherein an air gap is formed between said fixed contact plates in said terminal plate.

5. A contact structure of a sliding switch according to claim 4, wherein a protruding portion, which said protrusions of said movable contact plate can surmount, is formed on said surface of said terminal plate on both sides of said air gap.

6. A contact structure of a sliding switch, comprising:

a terminal plate provided with fixed contact plates; and a movable plate provided with a movable contact plate, which is selectively brought into contact with said fixed contact plates;

wherein each of said fixed contact plates has a fixed contact protruding above a surface of the terminal plate, and at least a pair of protrusions are formed on two sides of said movable contact plate;

wherein a relation L4>L2 exists, where L4 is a distance between each pair of said protrusions, and L2 is a transversal width of said fixed contact plates;

wherein a relation H1>H2 exists, where H1 is a height protruding upward of said fixed contacts, and H2 is a height of protrusions protruding downward from said bottom surface of said movable contact plate;

wherein an air gap is formed between said fixed contact plates in said terminal plate;

wherein a protruding portion, which said protrusions of said movable contact plate can surmount, is formed on said surface of said terminal plate on both sides of said air gap; and wherein said protruding portion is disposed in a transversal direction and has an approximately semicylindrical shapes, and a relation H1>H3 exists, where H3 is a height of said protruding portion, and H1 is the height of said fixed contacts.

* * * * *

UNITED STATES PATENT AND TRADEMARK OFFICE

CERTIFICATE OF CORRECTION

PATENT NO. : 5,898,142

DATED : April 27, 1999

INVENTOR(S) : Kazue OHTAKI and Mineo HIRANO

It is certified that error appears in the above-identified patent and that said Letters Patent is hereby corrected as shown below:

Claim 1 should read:

1. A contact structure of a sliding switch comprising:

a terminal plate provided with fixed contact plates; and a movable plate provided with a movable contact plate, which is selectively brought into contact with said fixed contact plates wherein each of said fixed contact plates has a fixed contact, protruding above an upper surface of the terminal plate, and

UNITED STATES PATENT AND TRADEMARK OFFICE

CERTIFICATE OF CORRECTION

PATENT NO. : 5,898,142

DATED : April 27, 1999

INVENTOR(S) : Kazue OHTAKI and Mineo HIRANO

It is certified that error appears in the above-identified patent and that said Letters Patent is hereby corrected as shown below:

said movable contact plate is formed approximately in a U shape with an upstanding front wall and an upstanding rear wall, and two pairs of downwardly extending protrusions are formed on each of two sides of a bottom surface of the movable contact plate at a front extremity portion and a rear extremity portion thereof, respectively, to form a lowermost portion of the movable contact plate.

Signed and Sealed this

Twenty-sixth Day of October, 1999

*Attest:*

Q. TODD DICKINSON

*Attesting Officer*

*Acting Commissioner of Patents and Trademarks*